US008690092B2

(12) United States Patent
Jenkins et al.

(10) Patent No.: US 8,690,092 B2
(45) Date of Patent: Apr. 8, 2014

(54) NUT GRINDER

(75) Inventors: Jack R. Jenkins, Stanwood, WA (US); Joel A. Jenkins, Marysville, WA (US); Alex M. Smith, Arlington, WA (US)

(73) Assignee: Country Living Productions, Inc., Stanwood, WA (US)

( * ) Notice: Subject to any disclaimer, the term of this patent is extended or adjusted under 35 U.S.C. 154(b) by 273 days.

(21) Appl. No.: 13/112,972

(22) Filed: May 20, 2011

(65) Prior Publication Data

US 2011/0284670 A1 Nov. 24, 2011

Related U.S. Application Data

(60) Provisional application No. 61/346,864, filed on May 20, 2010.

(51) Int. Cl.
*B02C 19/22* (2006.01)
*B02C 7/04* (2006.01)

(52) U.S. Cl.
USPC ..... 241/260.1; 241/247; 241/261.3

(58) Field of Classification Search
USPC ..... 241/247, 248, 260.1, 261.2, 261.3, 152, 241/152.2
See application file for complete search history.

(56) References Cited

U.S. PATENT DOCUMENTS

| | | | | | |
|---|---|---|---|---|---|
| 1,123,494 | A | * | 1/1915 | Craig | 241/259.3 |
| 1,947,342 | A | * | 2/1934 | Hess | 241/37 |
| 4,085,899 | A | * | 4/1978 | Boothe | 241/247 |
| 4,201,349 | A | * | 5/1980 | Walsh | 241/247 |
| 4,749,135 | A | * | 6/1988 | Walsh | 241/247 |
| 4,821,966 | A | * | 4/1989 | Ephraim et al. | 241/55 |
| 5,553,792 | A | * | 9/1996 | Romer et al. | 241/29 |

OTHER PUBLICATIONS

Jack R. Jenkins. "The Country Living Grain Mill." http://countrylivinggrainmills.com/index.php.

* cited by examiner

*Primary Examiner* — Faye Francis
(74) *Attorney, Agent, or Firm* — Christopher A. Wiklof; Launchpad IP, Inc.

(57) ABSTRACT

A nut grinder includes a nut auger, a stationary grinding plate, and a rotatable grinding plate configured to grind nuts. The nut auger and rotatable grinding plate may be adapted to receive rotational power from a human user or a mechanical source.

18 Claims, 12 Drawing Sheets

PRIOR ART

PRIOR ART

NUT GRINDER

CROSS-REFERENCE TO RELATED APPLICATIONS

The present application claims priority benefit from, and to the extent not inconsistent with the disclosure herein, incorporates by reference U.S. Provisional Patent Application Ser. No. 61/346,864, invented by Jack R. Jenkins, Joel A. Jenkins and Alex M. Smith, entitled NUT GRINDER, and filed May 20, 2010.

BACKGROUND

FIG. 1A is a perspective view of a grain grinder 101 made according to the prior art. FIG. 1B is a side sectional view of the grain grinder 101 of FIG. 1A. Referring to FIGS. 1A and 1B, the grain grinder 101 includes a body 102 that defines a cylindrical conveying volume 104 positioned to convey grain 105 from an input hopper 108 to a pair of grinding plates 112, 120. A shaft 111 is supported by bearings 128 and is positioned axially to the conveying volume 104. The shaft 111 supports a spring auger 106 that turns with the shaft to urge grain from the hopper end of the conveying volume to the pair of grinding plates 112, 120 at the output end of the cylindrical conveying volume 104. A stationary grinding plate 112 is coupled to the body 102 and positioned circumferentially to the shaft 110 such that grain may pass through an inner diameter 114 of the stationary grinding plate 112. The grain is conveyed by the spring auger 106 to a receiving volume (not shown) formed between depressions in grinding surfaces of the stationary grinding plate 112 and a rotatable grinding plate 120. A hand crank 122 may be positioned to receive human power to rotate the shaft 111, the spring auger 106, the grain meter 110, and the rotatable grinding plate 120 relative to the body 102, cylindrical conveying volume 104, and stationary grinding plate 112. The spring auger 106 urges grain from the hopper 108 to a nip between the grinding plates 112, 120. The receiving volume (not shown) may be comprised of facing hollowed sections of the grinding surfaces and configured to receive grain for initial grinding and movement to contacting regions of the grinding surfaces of the grinding plates 112, 120 located around the periphery of the grinding plates 112, 120. Grinding action between the stationary grinding plate 112 and the rotatable grinding plate 120 mills the grain into flour. The stationary grinding plate 112 and the rotatable grinding plate 120 may be about 5 inches in diameter.

Optionally, a person may provide a power source to the shaft 111. For example, the hand crank 122 may be operatively coupled the shaft 111. A person may provide rotational motion to the shaft 111, the spring auger 106, and the rotatable grinding plate 120. Alternatively, a person or a motor constrained to providing no more rotational power that the person may provide rotational motion to a pulley 126 that may include a V-groove capable of receiving rotational energy from a V-belt (not shown). The V-belt may be coupled to another human-powered source such as a stationary bicycle, or may be coupled to a motor.

While the grain grinder 101 is capable of producing flour, it is not capable of effectively grinding materials other than dry grains, nor is it capable of effectively producing a paste or butter. What is needed is a mechanism capable of milling oily or moist materials such as nuts into nut butters such as peanut butter.

SUMMARY

According to an embodiment, a nut grinder includes at least one body including a wall defining an axially symmetric conveying volume having an input end, an output end, and an axis; a first grinding surface operatively coupled to the at least one body and located adjacent to the output end of the conveying volume; a second grinding surface held in at least partial sliding rotational contact with the first grinding surface and configured to at least optionally receive rotational motion from a person; and an auger disposed circumferentially to the axis of the conveying volume, configured to at least optionally receive rotational motion from the person, configured to receive whole nuts responsive to only the force of gravity at or near the input end of the conveying volume, and configured to convey the whole nuts or nuts sliced by the auger to the output end of the conveying volume and the first and second grinding surfaces for grinding.

According to an embodiment, a nut grinder kit for converting a grain grinder to a nut grinder includes a sleeve configured for attachment to a body of a grain grinder, the sleeve including an inner sleeve wall defining a cylindrical conveying volume extending from a receiving region to an output end; a fixed grinding plate coupled to, configured for coupling to, or integral with the output end of the sleeve; a nut auger configured to be mounted on a shaft of the grain grinder, and configured for rotation within the cylindrical conveying volume of the sleeve and to receive nuts from a hopper of the grain grinder, wherein the nut auger includes one or more sharp edges configured to grab or slice nuts received from the hopper; and a rotatable grinding plate configured to couple to the shaft of the grain grinder and to be rotated synchronously with the rotation of the nut auger in rotating, sliding contact with the fixed nut grinding plate.

According to an embodiment, a method for grinding nuts includes receiving whole nuts from a hopper by gravity feed alone; receiving rotational motion constrained to a power and torque within a range available from one person; conveying the whole nuts with a screw conveyor or conveying, with the screw conveyor, nuts sliced by the screw conveyor to a pair of grinding plates, the screw conveyor being rotated by the received rotational motion; and grinding the nuts with the pair of grinding plates, at least one of the grinding plates being rotated by the received rotational motion.

DETAILED DESCRIPTION

Figure 1A:
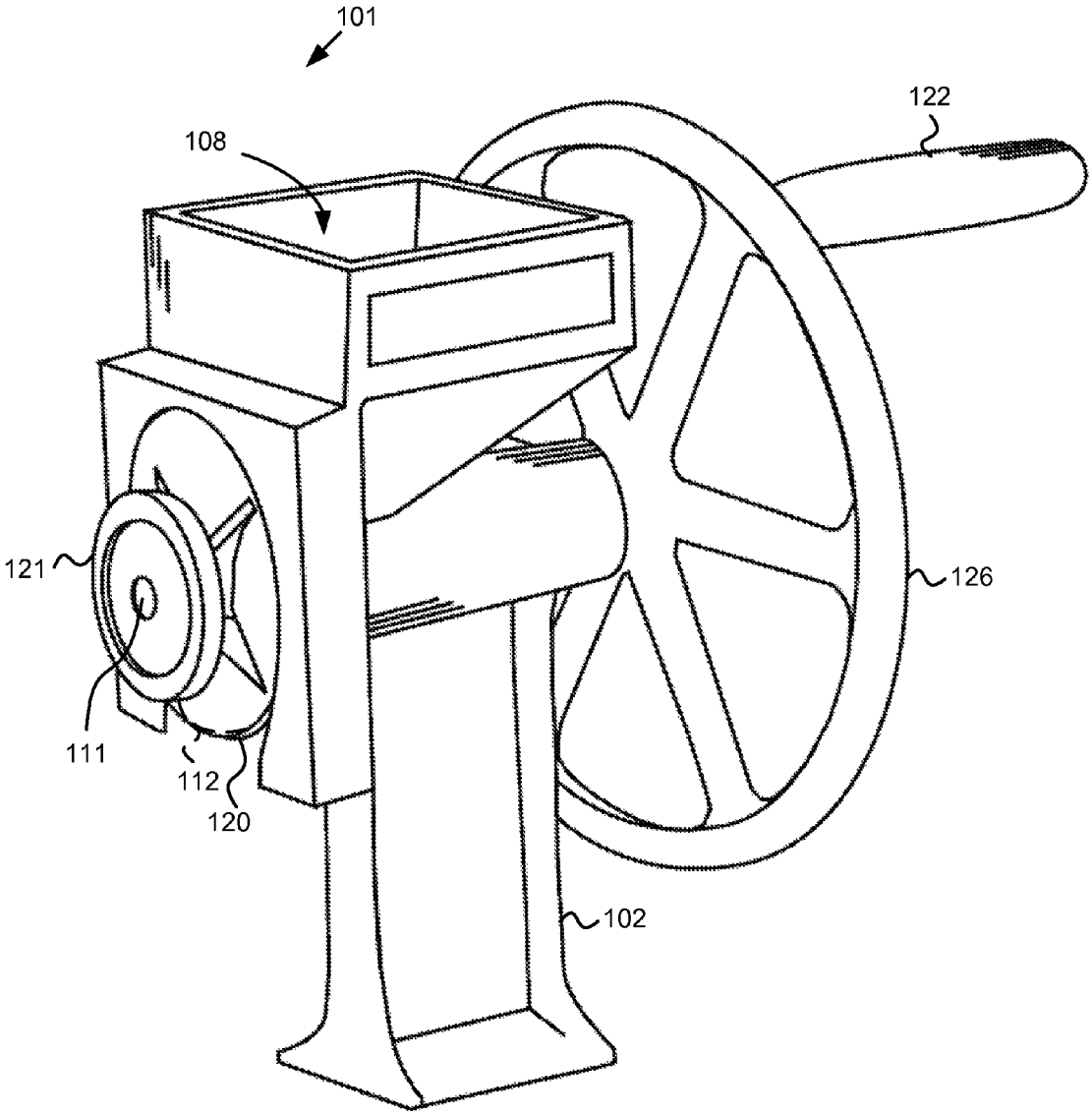
FIG. 1A is a perspective view of a grain grinder made according to the prior art.

In the following detailed description, reference is made to the accompanying drawings, which form a part hereof. In the drawings, similar symbols typically identify similar components, unless context dictates otherwise. Other embodiments may be used and/or and other changes may be made without departing from the spirit or scope of the disclosure.

Figure 2A:
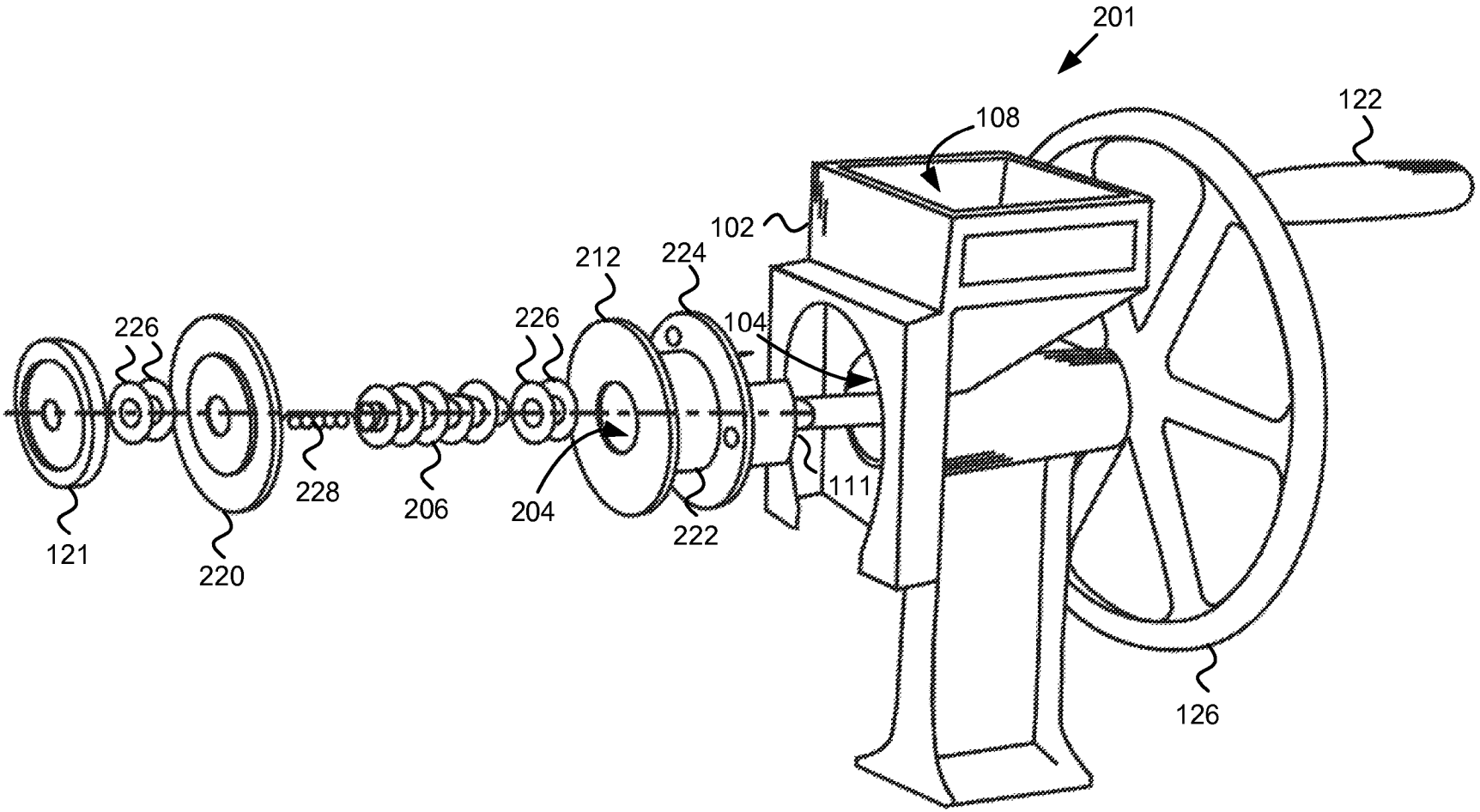
FIG. 2A is a perspective exploded view of a grinder configured to grind nuts, according to an embodiment.
Figure 2B:
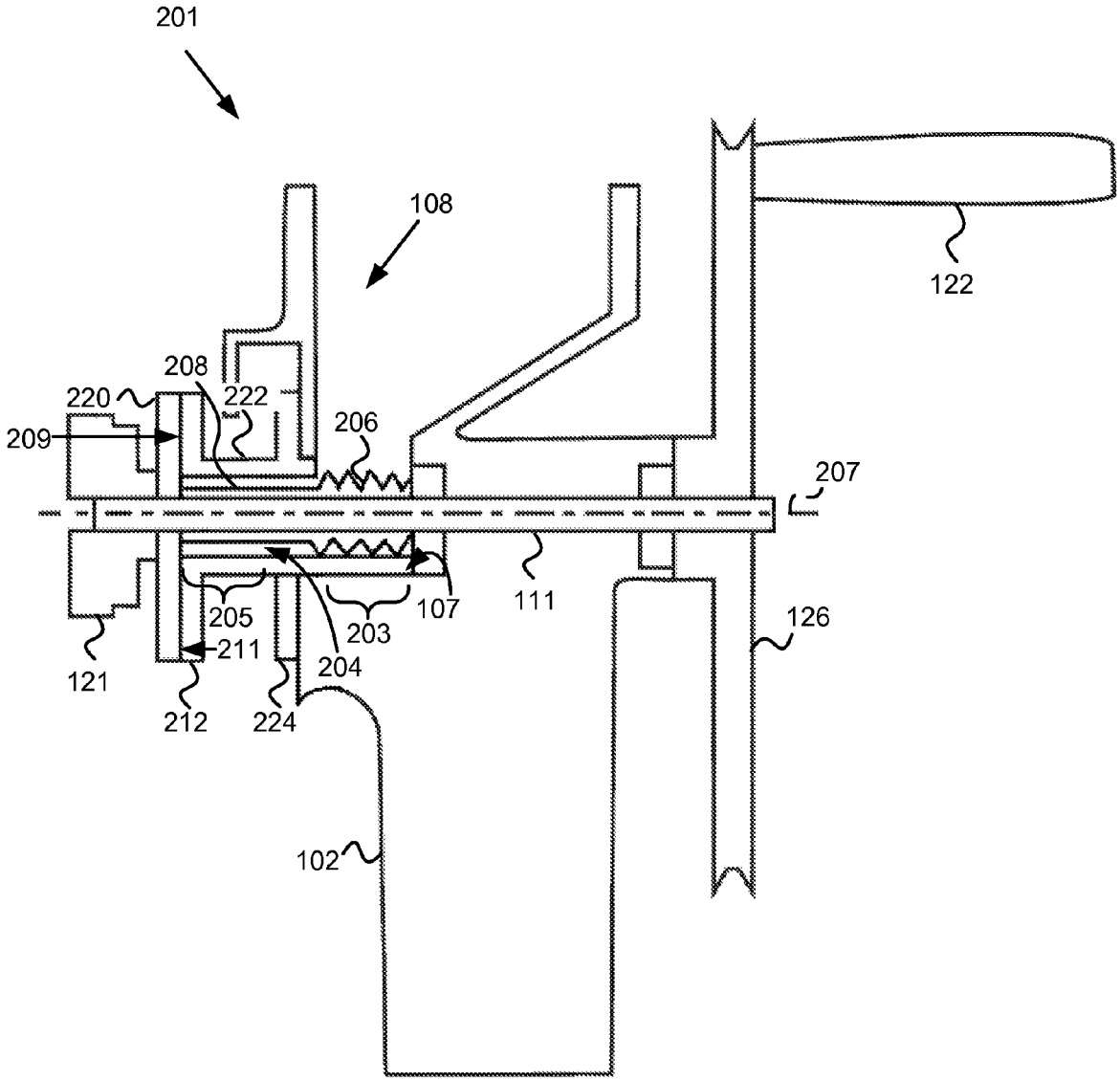
FIG. 2B is side sectional view of the grinder of FIG. 2A, according to an embodiment.

FIG. 2A is a perspective exploded view of a nut grinder 201 configured to grind nuts, according to an embodiment. FIG. 2B is side sectional view of the nut grinder 201 of FIG. 2A, according to an embodiment.

Figure 1B:
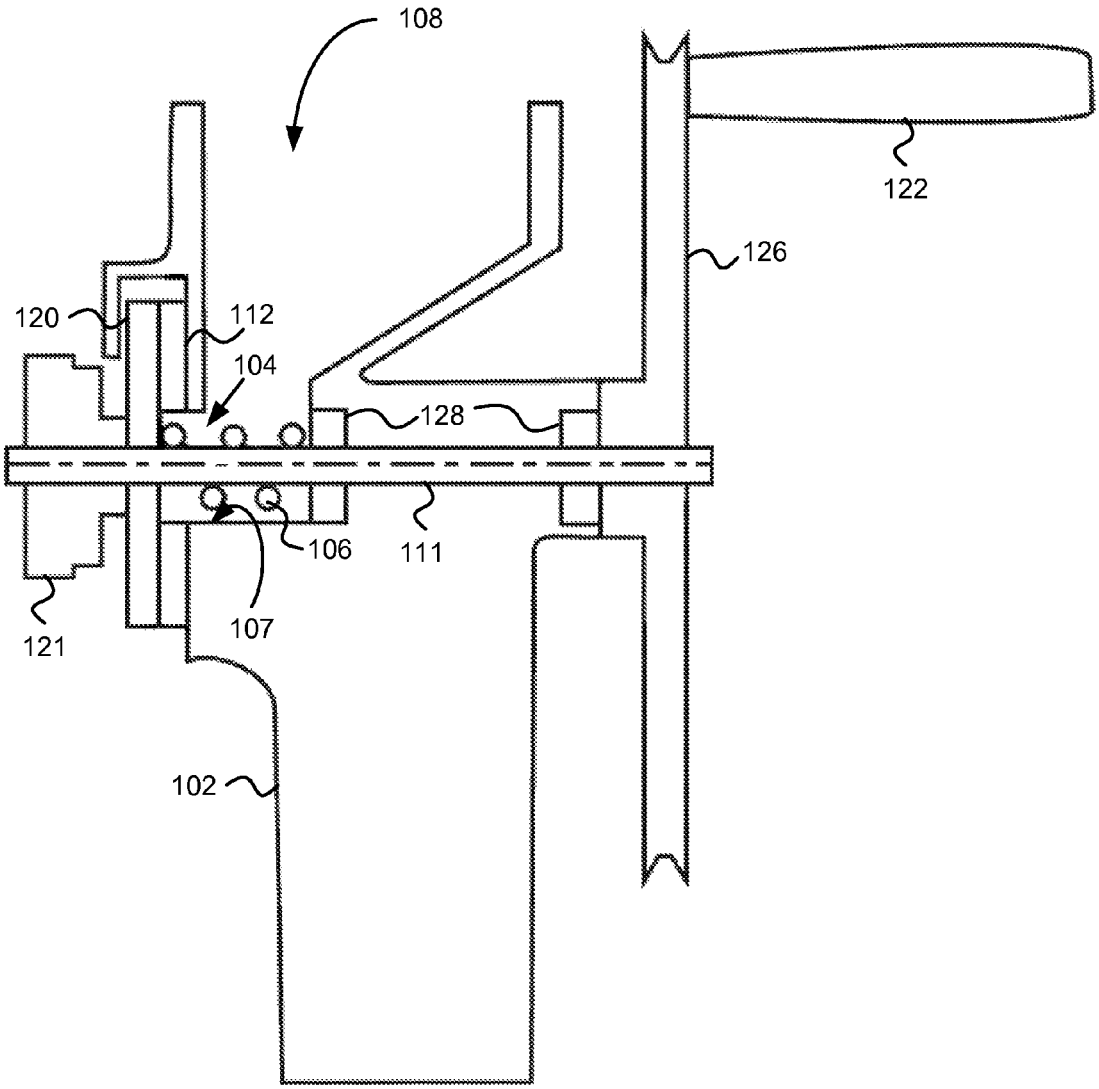
FIG. 1B is a side sectional view of the grain grinder of FIG. 1A.

Referring to FIGS. 2A and 2B, the nut grinder 201 may include portions of the grain grinder 101 of FIGS. 1A, 1B, for example, by removing some parts and installing a conversion kit, described below. Referring especially to FIG. 2A, a sleeve 222 including an inner wall 204 defining an axially symmetric conveying volume may be mounted on the grinder body 102 with a flange 224. The sleeve 222 may include an integral or assembled fixed grinding plate 212. One or more shims (e.g., flat washers) 226 may then be inserted over the shaft 111, such as to form thrust bearings. A nut auger 206 is next mounted on the shaft 111 followed by a compression spring 228, one or more additional shims 226, and a rotatable grinding plate 220. Optionally, the one or more additional shims 226 may be mounted on the outside of the rotatable grinding plate 220, as shown. Alternatively, some or all of the shims 226 may be omitted. A tension nut 121 then finishes the assembly. The tension nut may typically be hand rotated to reach a desired balance between nut paste consistency (tighter produces a finer nut paste) and resistance to turning the crank 122 and/or pulley 126. Since the nut grinder 201 may at least optionally be operated using muscular energy of a person, the parts illustrated in FIGS. 2A, 2B are designed to minimize torque requirements while producing a maximum amount of nut butter.

The nut grinder 201 may include at least one body 102, 222 including a wall 208 defining an axially symmetric conveying volume 204 having an input end 203, an output end 205, and an axis 207. As shown, the at least one body 102, 222 may include at least two bodies including a grinder body 102 including a wall 207 defining an outer conveying volume 104 (shown in FIG. 1B) and a sleeve 222 configured to mount at least partially inside the outer conveying volume 104. The wall defining the axially symmetric conveying volume 204 may be formed from an inner surface 208 of the sleeve 222. The sleeve 222 is described more fully in FIGS. 5A, 5B, and 5C and accompanying description below.

The axially symmetric conveying volume 204 may be formed as a cylindrical volume, for example. Optionally, with an appropriate change in shape of a nut auger 206, the axially symmetric conveying volume 204 may be formed as another axially symmetric shape, such as a truncated conical volume, an ellipsoidal volume, etc. The sleeve 222 may be formed from carbon steel or a stainless steel, for example. The grinder body 102 may be formed from a metal covered with a food-safe powder coating. According to an embodiment, the grinder body may be formed as an investment cast or sand cast aluminum. As may be appreciated, grinding nuts may involve providing greater conveying force than grinding grain. Providing a sleeve 222 with an inner wall 208 defining the conveying volume 204 may help provide a system 201 that delivers greater satisfactory conveying force, compared to using the inner wall 107 of the grinder body 102 to define conveying volume 104, 204.

For example, conveying nuts under relatively high pressure may tend, over time, to abrade food-safe powder coating on the surface 107 of the grinder body. This may eventually expose the nuts to raw aluminum, which is believed by some to leave a metallic taste and may be implicated in the initiation or progression of Alzheimer's disease in humans. Secondly, the nut grinder 201 includes a nut auger 206 that, in combination with the inner wall 208, forms a relatively close coupling to minimize the gap between nut auger 206 threads and the conveying volume wall 208. Casting processes, including sand casting or investment casting, may generally have relatively loose tolerances. To provide a high precision inner wall 208, it may be necessary to apply a secondary machining process or a more involved secondary machining process to the wall 107 produced by casting. Instead, it has been found to be optimal to machine the sleeve 222 to form a suitably precise wall 208, and thus allow the grinder body 102 to be manufactured with somewhat looser tolerances. Finally, according to some embodiments, an edge of the sleeve 222 positioned adjacent a hopper 102 on the input end 203 may cooperate with the nut auger 206 to produce a shearing action on nuts, thereby improving intake of the nuts into the conveying volume 204, and reducing or eliminating a need to pre-chop nuts or apply a non-gravitational compressive force on the nuts from the hopper 108 top.

A first grinding surface 209 may be operatively coupled to the at least one body 102, 222 and located adjacent to the output end 205 of the conveying volume 204. According to an embodiment, the first grinding surface 209 may be supported by a first grinding plate 212. According to an embodiment, the first grinding surface 209 may include a surface of a fixed grinding plate 212 that is mounted fixedly to the at least one body 102, 222, concentric and coplanar to the output end 205 of the conveying volume 204, as illustrated in FIG. 2B. Optionally, the first grinding plate 212 may be formed as a fixed grinding plate coupled to, configured for coupling to, or integral with the output end 205 of the sleeve 222.

As illustrated in FIG. 2B, the sleeve 222 may include an extension configured to support the first grinding plate 212 at a position away from the grinder body 102. Advantageously, this may help to reduce a potential mess and lost material compared to positioning the first grinding plate 212 within the dust shield, as with the first grinding plate 112 of the nut grinder 101 of FIGS. 1A, 1B. Whereas grinding a grain produces flour, grinding a nut may tend to form a paste, also referred to as nut butter. For example, grinding peanuts forms peanut butter. The resulting paste does not tend to fall out the bottom of the nip between the grinding plates, but rather extrudes out the entire periphery of the grinding plates 212, 220. By placing the nut grinding plates 212, 220 away from the grinder body 102, the extruded paste is free to break off and fall into a receptacle, rather than becoming a mess and adhering to the grinder body 102.

A second grinding surface 211 may be held in at least partial sliding rotational contact with the first grinding surface 209 and configured to at least optionally receive rotational motion from a person, such as via a shaft 111. The second grinding surface 211 may be supported by a rotatable grinding plate 220 that is coupled to rotate with the auger 206. The rotatable grinding plate 220 is described more fully in conjunction with FIGS. 4A and 4B.

An auger 206 may be disposed coaxially 207 with and in the conveying volume 204, configured to at least optionally receive rotational motion from the person, such as via the shaft 111. The auger 206 may be configured to receive whole nuts responsive to only the force of gravity. The nuts may be fed from a hopper 108 at or near the input end 203 of the conveying volume 204 and the auger 206. The auger 206 (which may be regarded as cooperating with the sleeve 222 to form a screw conveyor) may be configured to convey the whole nuts or nuts sliced by the auger 206 to the output end 205 of the conveying volume 204 and the first 209 and second 211 grinding surfaces for grinding. An embodiment of the auger 206 is described more fully in conjunction with FIGS. 3A, 3B, and 3C.

According to an embodiment, the body 102, 222 that defines a cylindrical conveying volume 204 may be positioned to convey nuts from a hopper 108 to a nip between the stationary nut grinding plate 212 and the rotatable nut grinding plate 220. A shaft 111 is positioned axially to the conveying volume 204. The shaft 111 supports the nut auger 206 that turns with the shaft to urge nuts from the hopper 108 end 203 of the conveying volume 204 through an inside diameter 214 of the stationary grinding plate 212 at the output end 205 of the conveying volume 204. The nuts are then forced into a nip between the stationary nut grinding plate 212 and the rotatable nut grinding plate 220.

The nut auger 206 may have an outer diameter sufficiently close to an inner wall 208 of the sleeve 222 to substantially prevent whole or partially processed nuts from passing counter current to the direction of conveyance by the nut auger 206. An extension of the sleeve 222 is configured to couple between the grinder body 102 and the stationary nut grinding plate 212 to support the stationary nut grinding plate 212 and the rotatable nut grinding plate 220 at a position spaced away from the grinder body 102. The extension and the stationary nut grinding plate 212 are coupled to the body 102 by a mounting plate 224.

The stationary nut grinding plate 212 and the rotatable nut grinding plate 220 are held in sliding rotational contact with one another. According to an embodiment, the stationary nut grinding plate 212 may be made substantially flat from its outer diameter with some concavity as it reaches its inner diameter 114. The rotatable nut grinding plate 220 may similarly be substantially flat across the outer perimeter of its grinding face which is in contact with the stationary nut grinding plate 212, but having concave characteristics as it reaches its inner diameter 114. Such an embodiment is similar to the grain grinder 101 depicted in FIGS. 1A, 1B, wherein both the stationary grinding plate 112 and the rotatable grinding plate 120 are shaped with hollows that cooperate to form a receiving volume. The stationary and rotatable nut grinding plates 212, 220 may be about 3.25 inches in diameter.

The smaller outside diameter of nut grinding plates 212, 220 compared to the grain grinding plates 112, 120 may help to reduce torque and energy input requirements of the nut grinder 201. According to an embodiment, the nut grinding plates 212, 220 are 3.25 inches in diameter, compared to the grain grinding plates 112, 120, which are about 5 inches in diameter. In some embodiments, this can be important because both the grain grinder 101 and the nut grinder 201 are intended to at least optionally be operated by a person and not require electricity. Since nuts offer more resistance to grinding, the smaller diameter plates 212, 220 help keep the torque and energy requirements within levels that may be received from a person.

A person may rotate the shaft 111, the nut auger 206, and the rotatable nut grinding plate 220 with a hand crank 122. Nuts are forced into the nip between the stationary and rotatable nut grinding plates 212, 220 by the nut auger 206. The nut auger 206 may be formed with an inner end of the auger blade cut to have sharp edge configured to cut nuts it encounters during rotation. This feature is visible in FIGS. 3A, 3B. Typically, and in contrast to most grains, nuts are oily. During grinding, the nut oil is released and mixed with the nut solids to form a paste. The nut paste is typically referred to as nut butter. The nut butter is extruded from the nip at the outer diameter of the grinding plates 212, 220. The extension of the sleeve 222 moves the grinding plates 212, 220 away from the body 102 of the grinder and the dust shroud, and thus prevents the nut butter from extruding to and creating a mess inside a dust shroud that extends partially around the stationary grinding plate 112 and rotatable grinding plate 120 of FIGS. 1A, 1B.

Optionally, a user may provide an alternative power source to the shaft 111. For example, a v-groove pulley 126 operatively coupled to the shaft 111 may be coupled via a belt to an electric motor or a human-powered source of locomotion, such as a stationary bicycle.

Figure 3A:
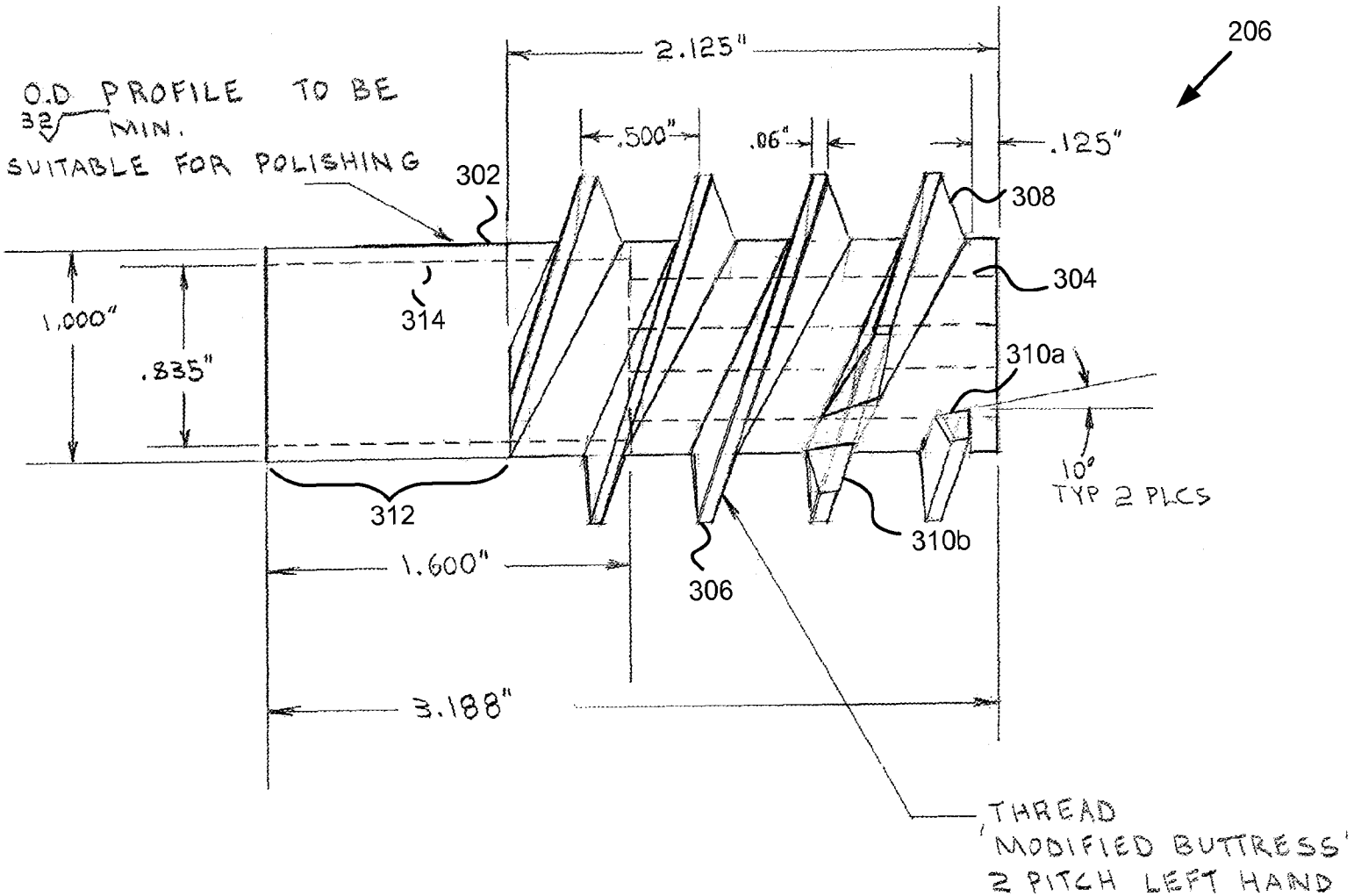
FIG. 3A is a dimensioned side view of an auger configured to convey nuts in the grinder of FIGS. 2A and 2B, according to an embodiment.
Figure 3B:
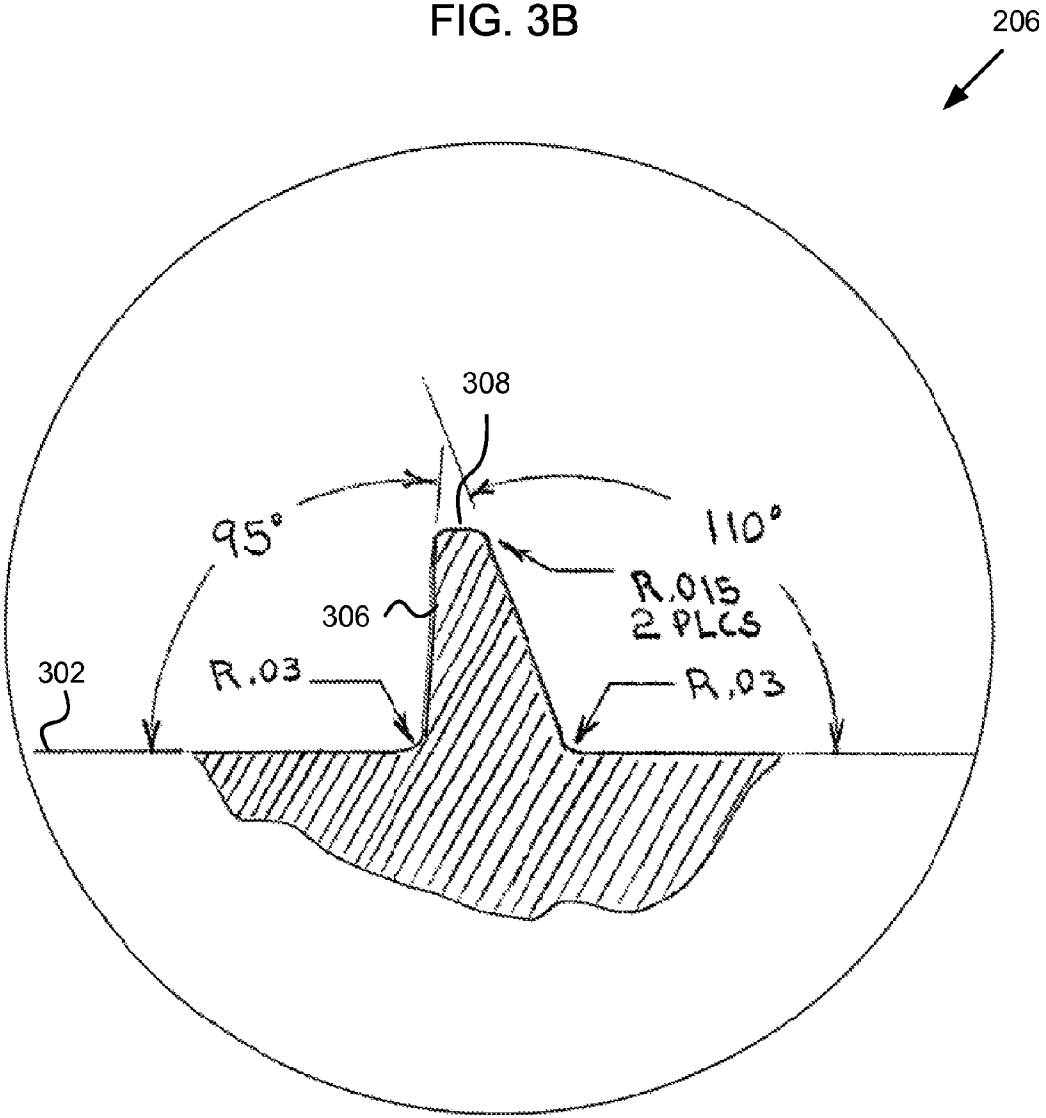
FIG. 3B is a detail view of a thread included in the auger shown in FIG. 3A, according to an embodiment.
Figure 3C:
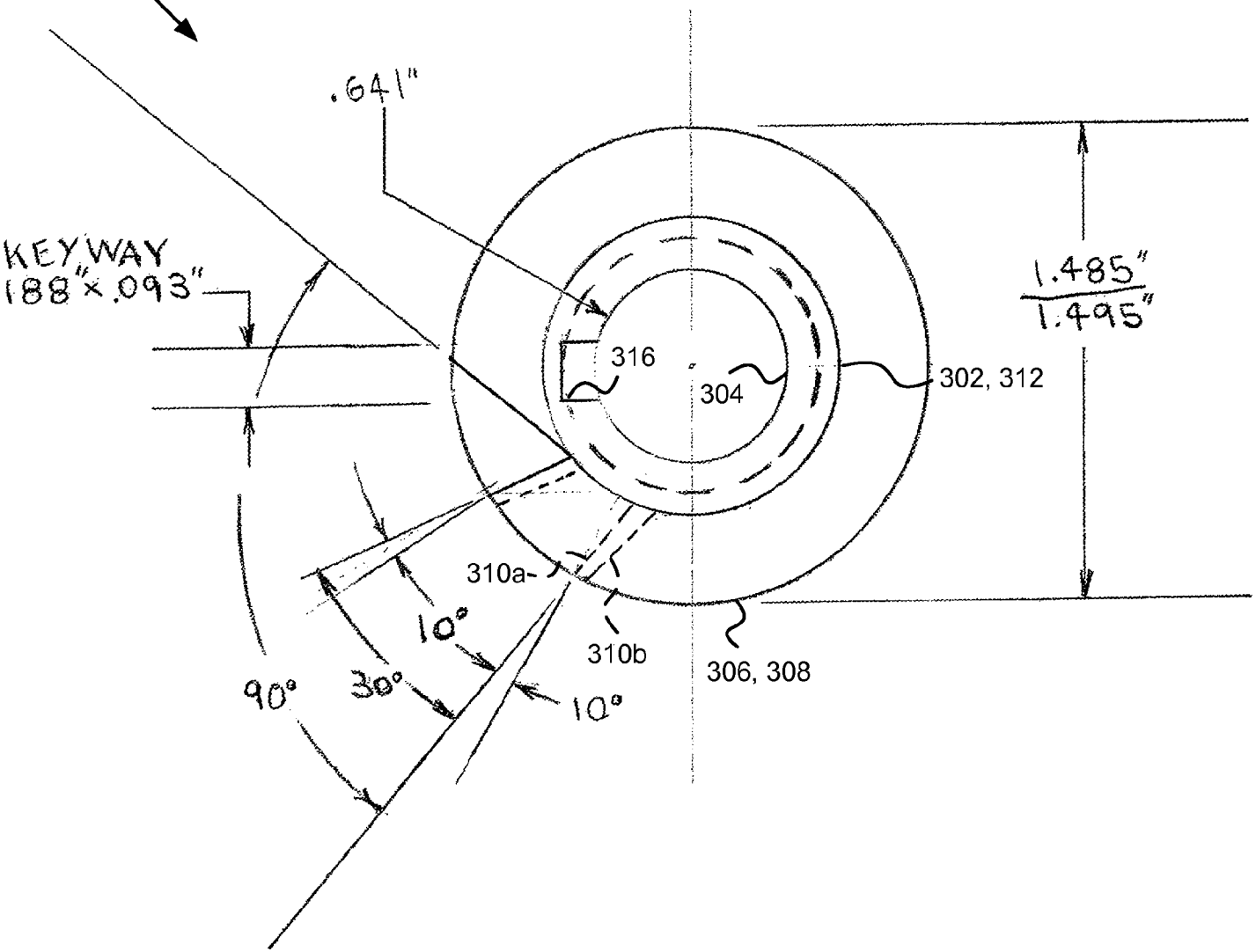
FIG. 3C is a dimensioned end view of the auger configured to convey nuts shown in FIGS. 3A and 3B, according to an embodiment.

FIG. 3A is a dimensioned side view of a nut 206 auger configured to convey nuts in the nut grinder 201 of FIGS. 2A and 2B, according to an embodiment. FIG. 3B is a detail view of a thread of the auger 206 shown in FIG. 3A, according to an embodiment. FIG. 3C is a dimensioned end view of the nut auger 206 shown in FIGS. 3A and 3B, according to an embodiment. FIG. 3C is a view taken from the left (output) end of the nut auger 206 depiction of FIG. 3A.

In reference to FIGS. 3A, 3B, and 3C, the nut auger 206 may include an auger surface 302 that is spaced away from a bore 304 sized for a non-interfering fit over the shaft 111 (not shown in FIGS. 3A, 3B, and 3C). One or more threads 306 are machined in the auger 206 to extend from the auger surface 302 to an outer diameter 308. According to an embodiment, the auger surface 302 has a diameter of 1.0 inch, the outer diameter 308 of the threads 306 is 1.485 to 1.495 inches, and the inner diameter for seating on the shaft is 0.641 inch. The auger 206 may include two threads formed according to a modified buttress cross section, shown in detail in FIG. 3B. The threads may be 2 pitch left-hand. Referring to FIG. 2A, left-hand threads 306 may result in delivering nuts from the hopper 108 to the grinding plates 212, 220 when the crank 122 and/or pulley 126 is rotated counterclockwise when viewed from the grinding plate side of the grinder 201.

Cuts 310*a*, 310*b* are made in two places across the threads 306 as shown in FIGS. 3A and 3C. These cuts result in sharp edges 310*a*, 310*b* being formed in the threads 306. The edges 310*a*, 310*b* of the cuts may be referred to colloquially as "nut hooks". It was found that including two nut hooks 310*a*, 310*b* located below the hopper at the angles and dimensions shown resulted in optimal non-aided passage of nuts from the hopper to the conveying volume. Without at least one nut hook 310*a*, 310*b*, it was found that for nut conveyance to work, one of two remedies needed to be implemented. Either the nuts needed to be chopped with a knife prior to putting the nuts in the hopper, or the nuts in the hopper needed to be manually pressed down with significant force to get them to feed through the nut grinder 201. Either remedy represents an inconvenience to the user.

As an option to one or more cuts 310*a*, 310*b* in the threads 306 of the auger, a separate nut cutter (not shown) may be included in the nut grinder 201. For example, a rotating knife edge may be geared to be driven from the auger 206 or the shaft 111 to cut the nuts, and thus satisfy receiving whole nuts responsive to only the force of gravity. But such an alternative may be less desirable than the cuts 310*a*, 310*b* shown, owing to greater cost, creation of a cutting hazard, incurring an increase in resistance to rotational motion, etc. Nevertheless, such alternatives may be considered to be within the scope and spirit of the disclosure and claims herein.

According to an embodiment, the threads end at a distance of 2.125 inches from the input end of the auger 206. A region near the output end of the auger 206 with no threads corresponds to a staging region 312 for the nuts. The staging region 312 was found to improve nut feeding and to minimize rotational power and torque required by the nut grinder. The staging region 312 appears to allow the nuts to self-assemble into a granular form adapted for easier transfer to the grinding surfaces, compared to a configuration without the staging region. A spring pocket 314 allows insertion of a compression spring to stabilize the grinder assembly. A keyway 316 is used to lock the auger 206 onto the shaft 111 to ensure that the auger 206 turns with the shaft 111. Optionally, the keyway 316 may be substituted with a clutch. The auger 206 may be formed from 1040 or 1045 carbon steel, for example. Optionally, the auger 206 may be formed from 304 or 304L stainless steel.

Figure 4A:
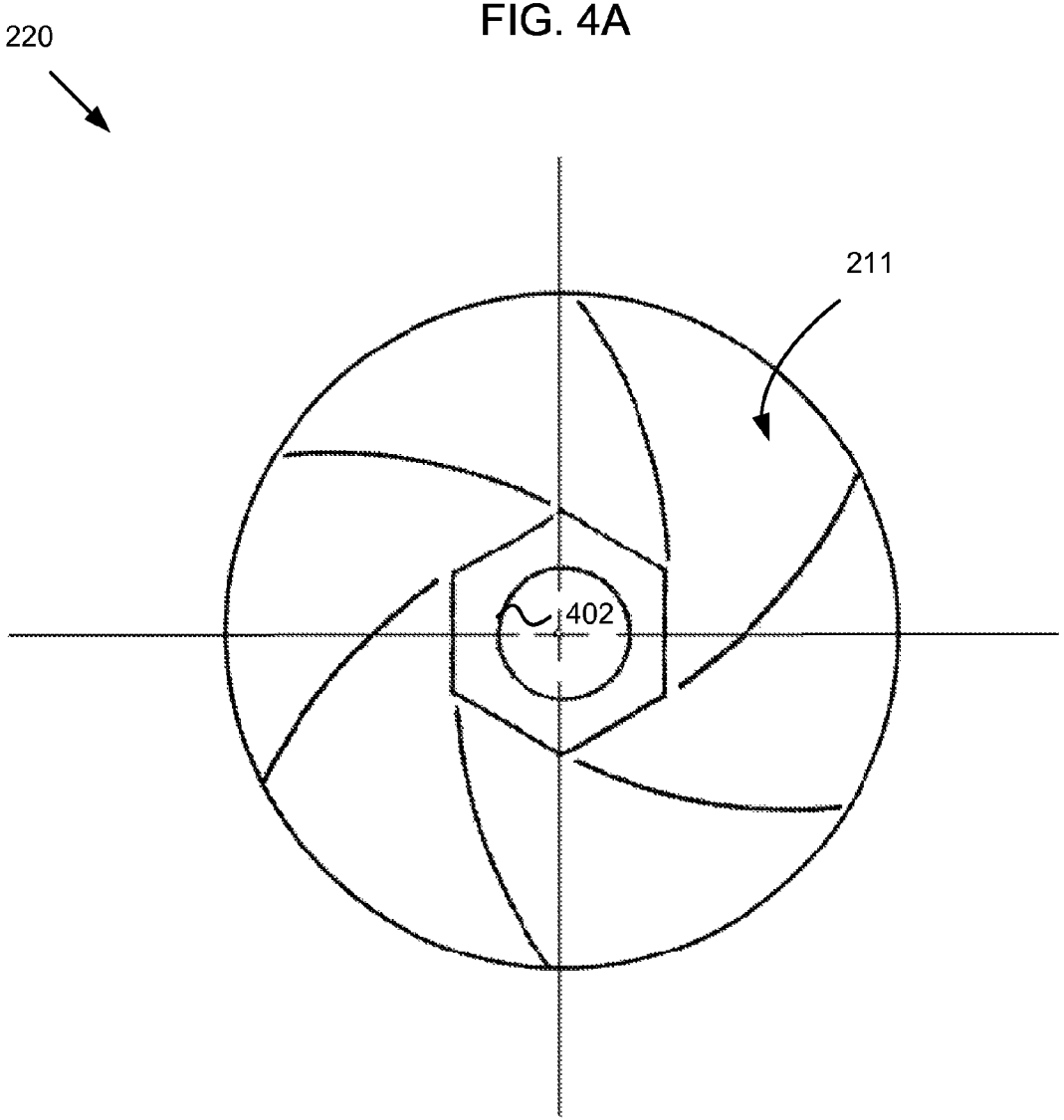
FIG. 4A is a view of a grinding surface of a rotatable grinding plate configured to grind nuts in the grinder of FIGS. 2A and 2B, according to an embodiment.
Figure 4B:
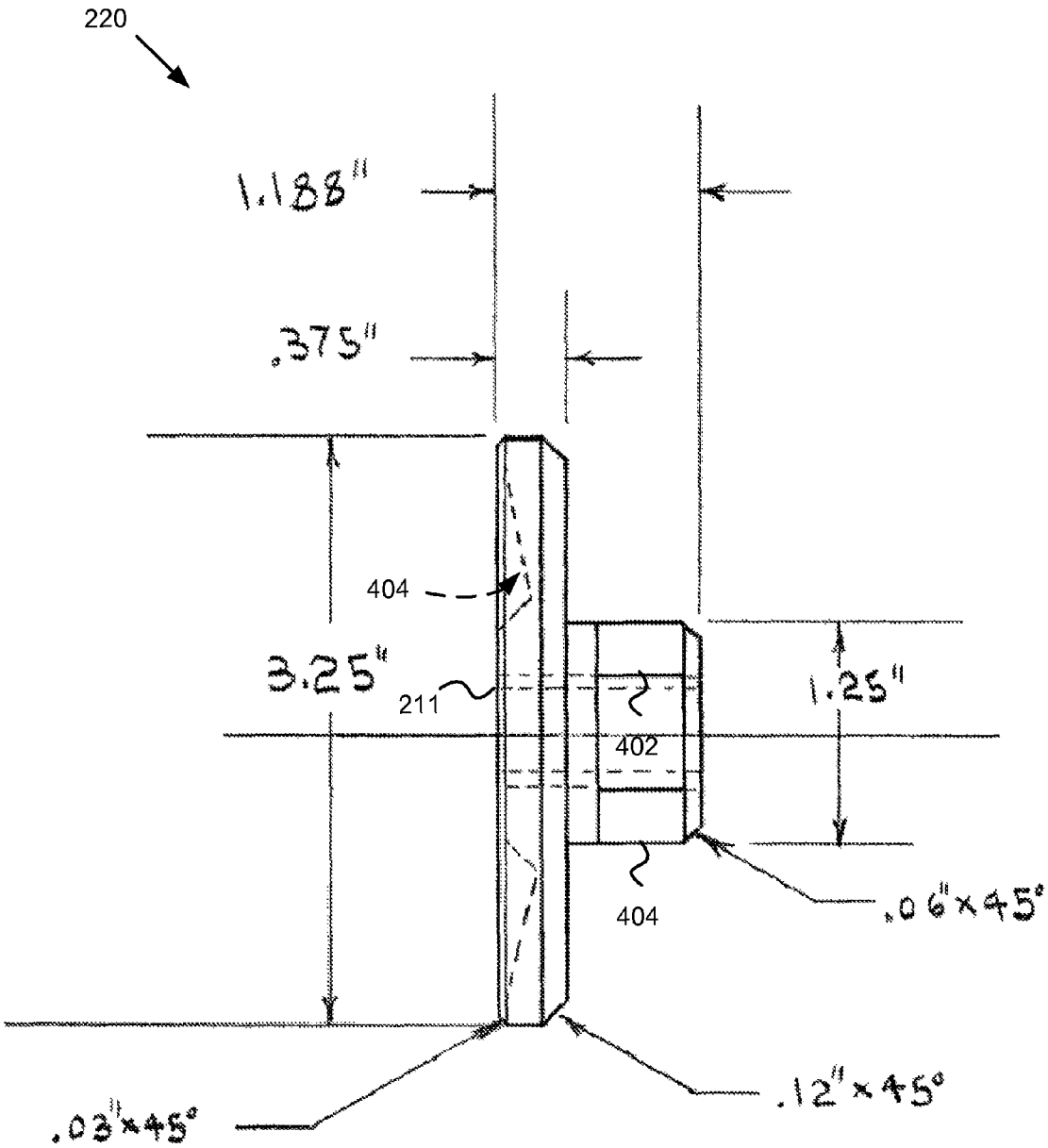
FIG. 4B is a dimensioned side view of the rotatable grinding plate of FIG. 4A, according to an embodiment.

FIG. 4A is a view of a grinding surface 211 of a rotatable grinding plate 220 configured to grind nuts in the nut grinder 201 of FIGS. 2A and 2B, according to an embodiment. FIG. 4B is a dimensioned side view of the rotatable grinding plate 220 of FIG. 4A, according to an embodiment. Referring to FIGS. 4A and 4B, the rotatable grinding plate 220 includes a bore 402 that is sized to hold the rotatable grinding plate 220 on the shaft 111 (see FIGS. 2A, 2B). Not shown is an optional keyway that may be used to maintain the rotatable grinding plate 220 in synchronous rotation with the shaft 111. The grinding surface 211 (also referred to as a second grinding surface herein) may include a region 404 visible in FIG. 4B that is depressed into the grinding plate. Typically, the grinding plate 220 may be formed by casting followed by machining to flatten the outer perimeter of the grinding surface 211. Machining may not affect the inner portion of the plate surface 211 because it includes the depression 404. The machined outer perimeter is the portion of the grinding plate 220 that is held in rotating, sliding contact with the first grinding surface 209 and the fixed grinding plate 212. The rotatable grinding plate 220 may be formed from 1040 or 1045 carbon steel, for example.

Figure 5A:
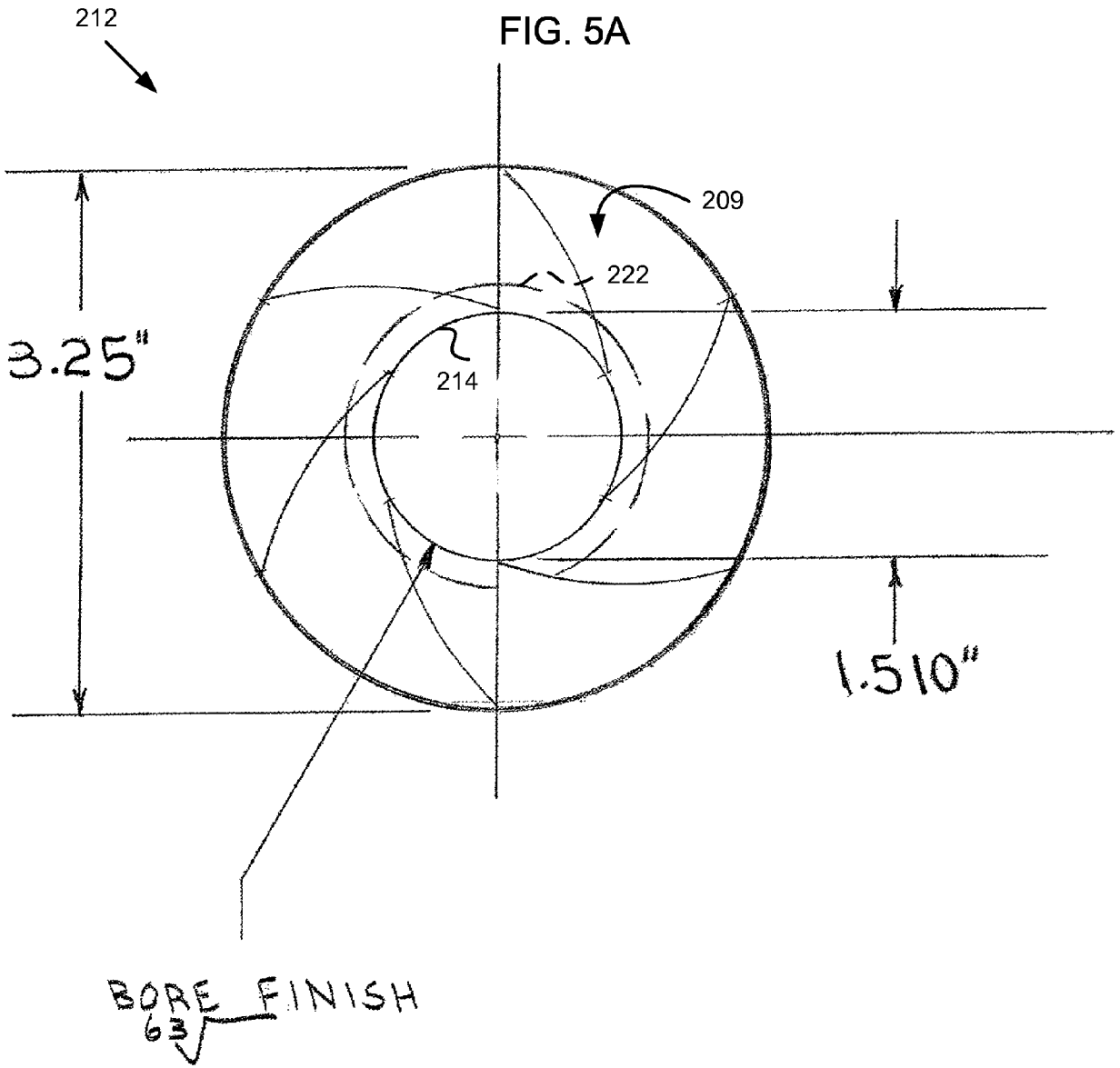
FIG. 5A is a dimensioned view of a grinding surface of a fixed grinding plate and an attached sleeve configured for use in the grinder of FIGS. 2A and 2B, according to an embodiment.
Figure 5B:
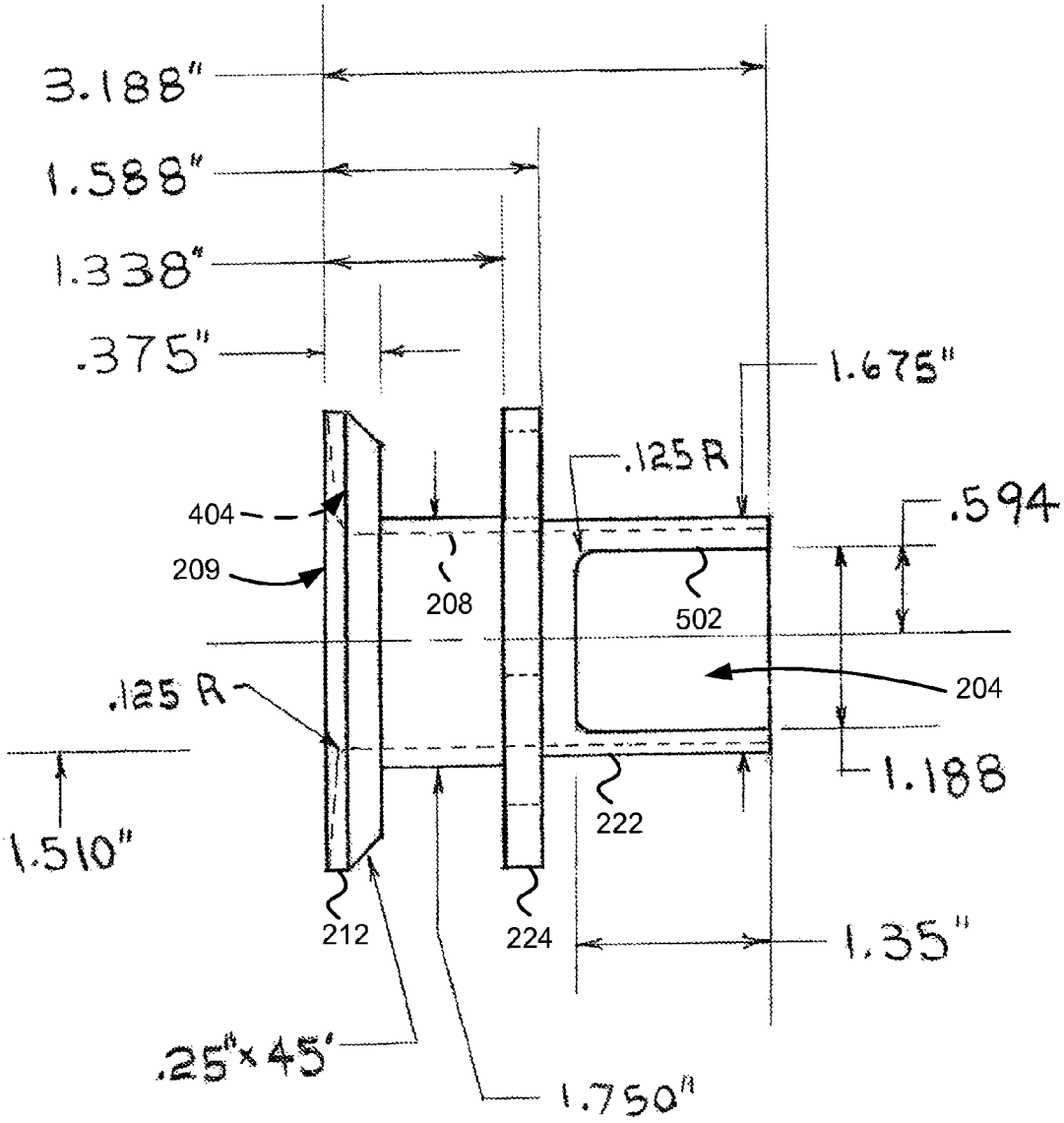
FIG. 5B is a dimensioned side view of the fixed grinding plate and attached sleeve of FIG. 5A, according to an embodiment.
Figure 5C:
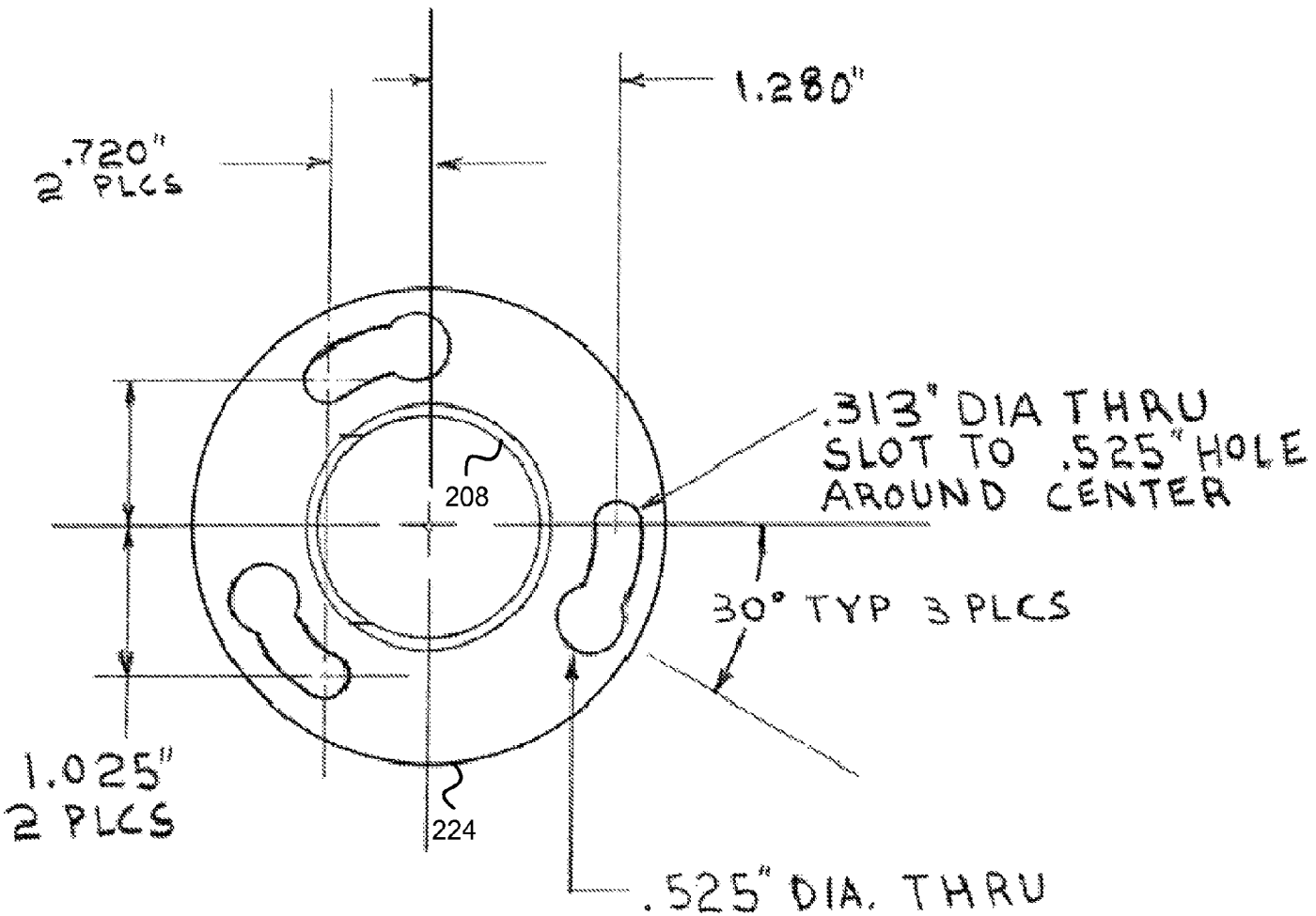
FIG. 5C is a dimensioned view of a mounting surface of the sleeve and attached fixed grinding plate shown in FIGS. 5A and 5B, according to an embodiment.

FIG. 5A is a dimensioned view of a grinding surface 209 of a fixed grinding plate 212 and an attached sleeve 222 configured for use in the nut grinder 201 of FIGS. 2A and 2B, according to an embodiment. FIG. 5B is a dimensioned side view of the fixed grinding plate 212 and attached sleeve 222 of FIG. 5A, according to an embodiment. FIG. 5C is a dimensioned view of a mounting surface 224 of the sleeve 222 and attached fixed grinding plate 212 shown in FIGS. 5A and 5B, according to an embodiment. Referring to FIGS. 5A, 5B, and 5C, the grinding surface 209 of the fixed grinding plate 212 may be substantially the same as the grinding surface 211 of the rotatable grinding plate 220, except that an inner diameter 214 of the fixed grinding plate defines an innermost edge of the grinding surface 209. The inner diameter 214 of the fixed grinding plate may be formed at substantially the same radius as the sleeve wall 208. The depressed region 404 in the grinding surface 209 of the fixed grinding plate 212 (indicated in FIG. 5B) may be configured to cooperate with the corresponding depressed region 404 in the grinding surface 211 of the rotatable grinding plate 220 (indicated in FIG. 4B) to form a receiving volume for receiving a flow of nuts from the auger 206. Relatively "chunky" nuts, such as whole nuts or nuts sliced or mashed by the auger 206 may be able enter the receiving volume defined by the depressed regions 404. As may be seen, the depressed regions 404 taper to meet the contacting portions of the grinding surfaces 209, 211. The "tooth" of the grinding surfaces 209, 211 in the depressed region performs an initial milling of the nuts and nut pieces, reducing their size. The reduced size nut pieces travel further toward the periphery of the grinding surfaces 209, 211 and through the contacting regions of the grinding surfaces 209, 211. In the process of this travel, nut pieces may be progressively classified to smaller and smaller pieces, extracting nut oils in the process, and forming a paste or "nut butter" that exudes from the peripheral edge of the contacting grinding surfaces 209, 211. Optionally, one or more deeper toothed features may be formed in the grinding surfaces 209, 211 to allow a fraction of the received nuts to be exuded as nut chunks. This may be used, for example, for making chunky peanut butter and the like.

Referring to FIG. 5B, an aperture 502 may be formed in the sleeve 222. The aperture 502 may be positioned (when assembled) below the hopper 108 to admit the nuts into the axially symmetric conveying volume 204. It should be noted that the aperture 502, which may substantially be a missing region of the sleeve 222 wall, should not be considered as inconsistent with the notion of an axially symmetric conveying volume 204. The conveying volume 204 itself may be considered axially symmetric whether or not one or more portions of the wall of the sleeve 222 may be missing. Rather, the concept of axial symmetry is such that the outer periphery 308 of a corresponding auger 206 may maintain a substantially constant clearance from the wall in places where the wall is present such that the auger 206 may be rotated about the axis without encountering a mechanical interference. One or more grooves, dimples, or other features may similarly be formed in the surface 208 of the wall of the sleeve 222 without destroying the axial symmetry of the conveying volume 204.

Optionally, the aperture 502 and the auger 206 thread(s) 306, and/or the aperture 502 and the sharp feature(s) 310*a*, 310*b* in the auger 206 thread(s) 306, may cooperate to form a scissor-like effect wherein nuts received from the hopper 108 are automatically sliced, pre-milled, ground, scraped, or otherwise altered to promote induction of the nuts into the axially symmetric conveying volume 204. As may be seen in the depicted illustrative embodiment 222, the axially symmetric conveying volume may be substantially cylindrical.

Referring especially to FIGS. 5B and 5C, a mounting flange 224 may be formed to mount the sleeve 222 on the grinder body 102. Typically, the slots and holes depicted in FIG. 5C are formed to allow mounting of the mounting flange 224 and the sleeve 222 using tapped holes (not shown) used to mount the fixed grinding plate 112 of the grain grinder 101. The same (e.g., countersunk, hex head, stainless steel) screws (not shown) may be used to mount the mounting flange 114 and the sleeve 222 as the grain grinding plate 112, or alternatively, the screws may be replaced with a non-countersunk screw. In the case of using non-countersunk screws, the nut grinder kit described below may include the replacement screws. To mount the sleeve 222, the screws (not shown) are typically started into the tapped holes (not shown) in the grinder body 102; the holes of the mounting flange 224 are inserted over the screw heads; and the sleeve 222 and the mounting flange 224 are rotated clockwise through the slots to capture the mounting flange 224. The screws (not shown)

may then be tightened, such as with a short end of a hex key, to solidly mount the sleeve 222 and the mounting flange 224 to the grinder body 102.

The sleeve 222 may be formed from 1040 or 1045 carbon steel, for example.

Optionally, the grinding surfaces 209, 211 may be formed in a different configuration than the embodiment 212, 220 illustratively described herein. For example, the grinding surfaces 209, 211 may be configured as concentric tubular/cylindrical surfaces, ellipsoidal or spherical surfaces, conical surfaces, paraboloids of revolution, or another grinding surface pair configured to grind nuts. Embodiments may be selected to be driven with a power and/or torque within a range available from a person.

Optionally, according to an embodiment, a kit for converting a grain grinder 101 into a nut grinder 201 may include the sleeve 222 and a fixed grinding plate 212 coupled to, configured for coupling to, or integral with the output end of the sleeve 222 as illustratively depicted in FIGS. 5A, 5B, and 5C; the nut auger 206 such as the illustrative embodiment shown in FIGS. 3A, 3B, and 3C; and the rotatable grinding plate 220 such as the embodiment shown in FIGS. 4A and 4B. Optionally, the kit may include a spring 228 configured to couple between the nut grinder body 102 and the rotatable grinding plate in compressive balance with the shaft 111. Optionally, an alternative compression, tension, or torsion spring configuration may be coupled to balance pressure between the grinding surfaces 209, 211; and a corresponding alternative spring or spring assembly may be included in the kit. Optionally, distances corresponding to the auger 206 length; auger spring pocket 314 depth; shim stack 226 height; exposed shaft 111 length; bearing 128 position; and/or conveying volume 204 length (which may be determined at least in part by the sleeve 222 extension length) may be selected to allow use of the grain grinder 101 spring auger 106; and a spring may be omitted from the kit. In such a case, referring to FIG. 2A, the spring 228 may be replaced by the spring auger 106 (e.g., salvaged from the grain grinder 101). Typically, (referring to FIG. 1A) the compression nut 121, shim(s) 226, shaft 111, and grain grinder body 102 from the grain grinder may be provided by the user by salvaging the parts from the grain grinder 101, and (unless for repair purposes, for example) such parts that are common between the grain grinder 101 and nut grinder 201 configurations may be omitted from the kit. Optionally, one or more alternative nut slicing assemblies may be included in the kit. Optionally, as with the nut grinder 201 itself, the grinding surfaces may be a different configuration than the embodiment 212, 220. For example, the grinding surface may be configured as concentric tubular/cylindrical surfaces, ellipsoidal/spherical surfaces, conical surfaces, or another grinding surface pair configured to grind nuts and driven with a power and/or torque within a range available from a person. The kit may be configured to cause the resultant assembly 201 to operate as described elsewhere herein.

The kit for converting a grain grinder 101 into a nut grinder 201 may further include printed instructions (not shown) adapted to instruct a user how to convert the grain grinder 101 into a nut grinder 201, and back again.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A nut grinder, comprising:

a grinder body defining an outer volume;

a sleeve configured to mount at least partially inside the outer volume, an inner surface of the sleeve forming a wall defining an axially symmetric conveying volume having an input end, an output end, and an axis;

a first grinding surface operatively coupled to the at least one body and located adjacent to the output end of the conveying volume;

a second grinding surface held in at least partial sliding rotational contact with the first grinding surface and configured to receive rotational motion; and an auger disposed coaxially with and in the conveying volume, configured to receive the rotational motion, configured to receive whole nuts responsive to only the force of gravity at or near the input end of the conveying volume, and configured to convey the whole nuts or nuts sliced by the auger to the output end of the conveying volume and the first and second grinding surfaces for grinding.

2. The nut grinder of claim 1, further comprising:

a hopper for feeding the whole nuts to or near the input end of the conveying volume and the auger.

3. The nut grinder of claim 1, wherein the grinder body is formed from a metal covered with a food-safe powder coating.

4. The nut grinder of claim 1, wherein the sleeve is formed from a carbon steel or a stainless steel.

5. The nut grinder of claim 1, further comprising:

a first grinding plate supporting the first grinding surface; and wherein the sleeve further comprises an extension configured to support the first grinding plate at a position away from the grinder body.

6. The nut grinder of claim 1, wherein the axially symmetric conveying volume comprises a cylindrical volume.

7. The nut grinder of claim 1, wherein the first grinding surface includes a surface of a fixed grinding plate that is mounted fixedly to the at least one body, concentric and coplanar to the output end of the conveying volume.

8. The nut grinder of claim 1, wherein the second grinding surface includes a surface of a rotatable grinding plate that is coupled to rotate with the auger.

9. The nut grinder of claim 1, further comprising:

a crank, pulley, or crank and pulley configured to receive the rotational motion;

a rotatable shaft disposed along the axis of the conveying volume, supported by the at least one body, and coupled to be driven in rotation by the crank, pulley, or crank and pulley; and a rotatable grinding plate on which the second grinding surface is disposed, the rotatable grinding plate being operatively coupled to the rotatable shaft;

wherein the auger is operatively coupled to the rotatable shaft and configured to rotate with the rotatable shaft and the rotatable grinding plate when the rotatable shaft is driven in rotation by the crank, pulley, or crank and pulley.

10. The nut grinder of claim 9, further comprising:

an electric motor operatively coupled to the crank, pulley, or crank and pulley and configured to provide the rotational motion;

wherein the electric motor is configured to provide a power and torque to the rotatable shaft that is not greater than what could be provided by one person.

11. The nut grinder of claim 9, further comprising:

at least one second pulley; and a belt configured to transmit rotational motion from the second pulley to the pulley;

wherein the second pulley is configured to receive rotational motion from a stationary bicycle, treadmill, stair climber, or elliptical exercise machine that is driven by a person.

12. The nut grinder of claim 1, wherein the auger is configured to cooperate with the wall defining the conveying volume to form a screw conveyor.

13. The nut grinder of claim 1, wherein the auger includes threads;

wherein the auger threads are cut in two or more places; and wherein the cuts in the auger threads are configured to slice or couple to the whole nuts to cause the whole nuts or sliced nuts to enter the conveying volume without requiring the whole nuts to be pre-chopped and without requiring pressing the whole nuts downward with greater than gravitational force acting on the nuts.

14. The nut grinder of claim 1, wherein the auger includes threads;

wherein the auger threads are not present in a region of the auger near the output end of the conveying volume; and wherein a region of the conveying volume peripheral to the portion of the auger missing the auger threads is configured as a staging region to allow the nuts to self-assemble into a granular form adapted for easier transfer to the grinding surfaces, compared to a configuration without the staging region.

15. The nut grinder of claim 1, further comprising:

a shaft configured to receive the rotational motion from a single person;

wherein the second grinding surface and the auger are configured to receive the rotational motion from the shaft.

16. The nut grinder of claim 1, wherein the auger includes one or more threads having an outer diameter sufficiently close to the wall defining the axially symmetric conveying volume to substantially prevent whole or partially processed nuts from passing between the one or more threads and the wall.

17. A nut grinder kit for converting a grain grinder to a nut grinder, comprising:

a sleeve configured for at least partial insertion into an outer volume defined by a body of a grain grinder, the sleeve including an inner sleeve wall defining a cylindrical conveying volume extending from a receiving region to an output end;

a fixed grinding plate coupled to, configured for coupling to, or integral with the output end of the sleeve;

a nut auger configured to be mounted on a shaft of the grain grinder, and configured for rotation within the cylindrical conveying volume of the sleeve and to receive nuts from a hopper of the grain grinder, wherein the nut auger includes one or more sharp edges configured to grab or slice nuts received from the hopper; and a rotatable grinding plate configured to couple to the shaft of the grain grinder and to be rotated synchronously with the rotation of the nut auger in rotating, sliding contact with the fixed nut grinding plate.

18. The nut grinder kit for converting a grain grinder to a nut grinder of claim 17, wherein the grain grinder and the grain grinder with the nut grinder kit are configured to operate using power input from a person or from a motor configured to provide power not exceeding the power input able to be provided by the person.

* * * * *